United States Patent [19]

Duckett

[11] Patent Number: 4,636,108

[45] Date of Patent: Jan. 13, 1987

[54] FLEXIBLE SURFACE MOUNT DELINEATOR

[76] Inventor: John W. Duckett, P.O. Box 9058, San Rafael, Calif. 94902

[21] Appl. No.: 617,366

[22] Filed: Jun. 5, 1984

[51] Int. Cl.[4] ..... E01F 9/00

[52] U.S. Cl. ..... 404/10; 404/72; 116/63 R; 264/159

[58] Field of Search ..... 404/6, 9–11, 404/14, 16, 72; 256/1, 13.1; 264/159; 116/63 R, 63 P; 294/55

[56] References Cited

U.S. PATENT DOCUMENTS

| | | | |
|---|---|---|---|
| 625,629 | 5/1899 | Wyatt | 294/55 |
| 1,284,376 | 11/1918 | Lehman | 404/11 X |
| 2,127,037 | 8/1938 | La Croix | 404/16 |
| 3,674,304 | 7/1972 | Swanson | 256/1 |
| 3,709,112 | 1/1973 | Ebinger | 256/13.1 X |
| 4,240,766 | 12/1980 | Smith et al. | 404/10 |

FOREIGN PATENT DOCUMENTS

| | | | |
|---|---|---|---|
| 442145 | 3/1927 | Fed. Rep. of Germany | 294/55 |
| 713926 | 9/1966 | Italy | 404/6 |
| 359657 | 2/1962 | Switzerland | 264/159 |
| 2122240 | 1/1984 | United Kingdom | 404/9 |

*Primary Examiner*—James A. Leppink
*Assistant Examiner*—John F. Letchford
*Attorney, Agent, or Firm*—Phillips, Moore, Lempio & Finley

[57] ABSTRACT

A delineator comprises an upstanding flexible marker having a first access opening formed through a bottom wall thereof to receive a fastener, such as a bolt, therethrough. A second access opening is formed through a side wall of the marker to accommodate a wrench for the purpose of selectively tightening or releasing the bolt. In one embodiment of the invention, a mounting plate, having the bolt secured thereon, is secured to a paved roadway or the like with the bolt extending upwardly through the first access opening and having a nut threaded thereon for the purpose of securing the marker in place. In a second described embodiment, a mounting post is driven into the ground and has screw threads defined therein with the bolt extending downwardly through the first access opening and threadedly engaged with the screw threads.

4 Claims, 9 Drawing Figures

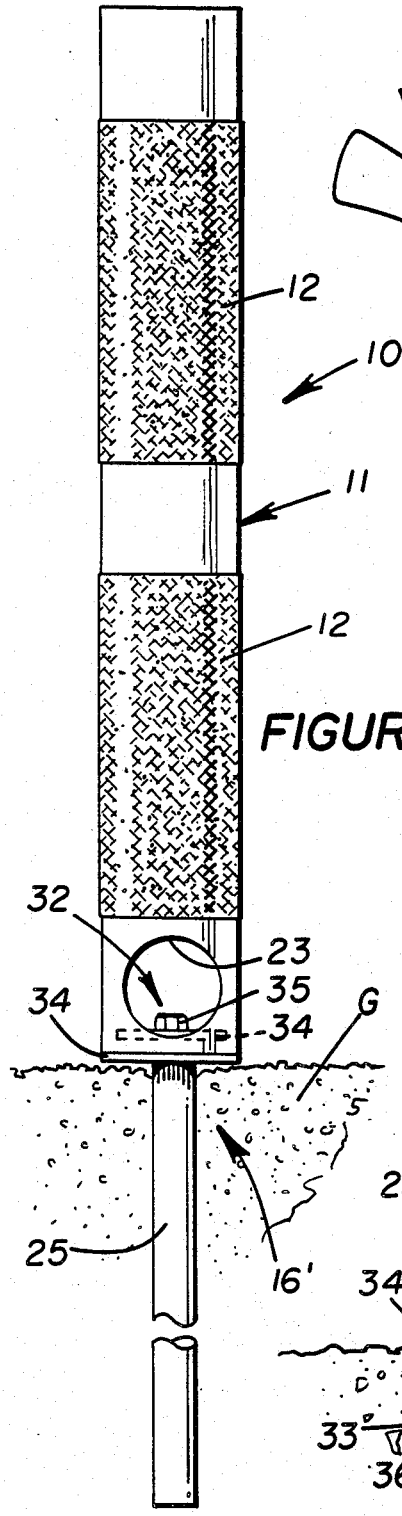
FIGURE 4
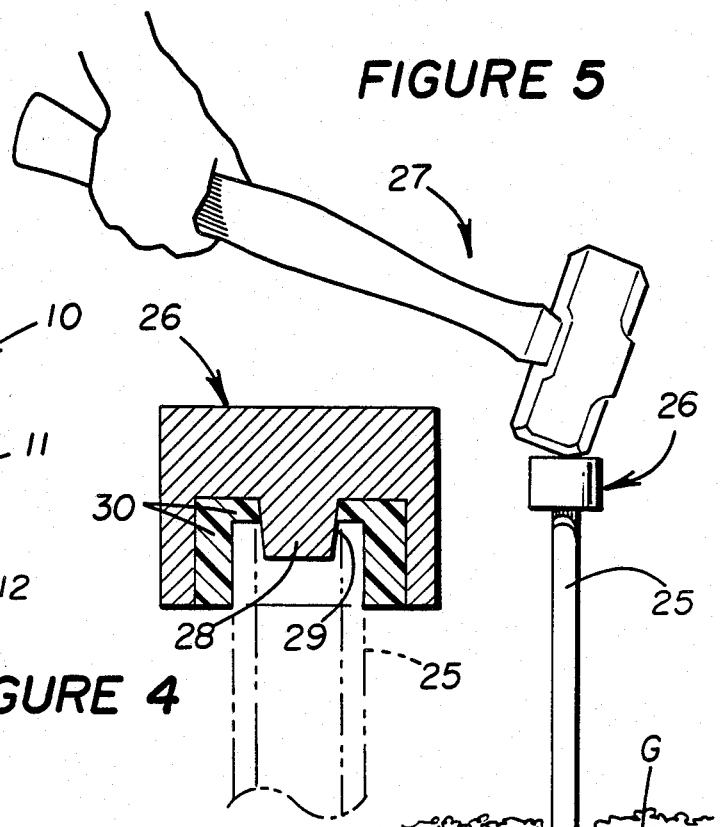
FIGURE 5
FIGURE 6
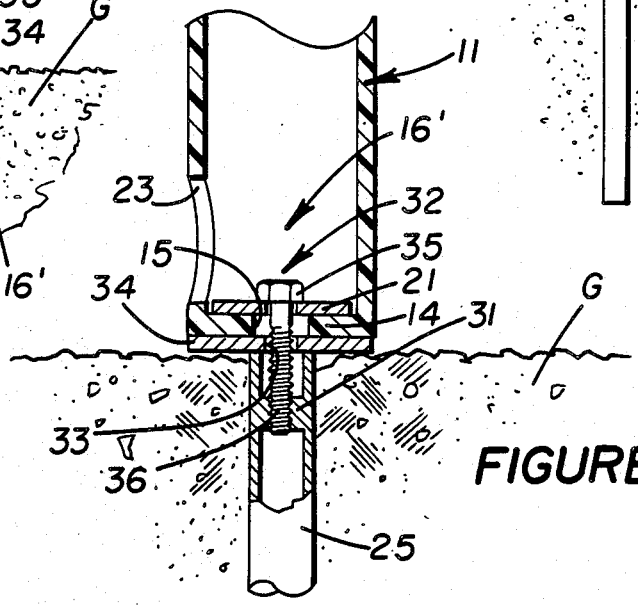
FIGURE 7

FLEXIBLE SURFACE MOUNT DELINEATOR

TECHNICAL FIELD

This invention relates to a delineator adapted to be mounted at ground level and more particularly to a delineator comprising a flexible marker adapted to be releasably attached to a ground surface, such as on or alongside a roadway.

BACKGROUND OF THE INVENTION

Surface mount delineators normally comprise an upstanding marker in the form of a flexible tube composed of a plastic material that will flex when impact loads are imposed thereon. The tube is either mounted on a base that is positioned in unattached relationship on a roadway or the like or includes a mounting projection secured on its lower end for insertion into a mounting hole. The latter type of mounting arrangement is exemplified by the "fixed location" type of delineator used on the Golden Gate Bridge in San Francisco, Calif.

Delineators of the above type are oftentimes struck by an automobile, which will either tend to destroy the delineator upon repeated impact and/or will displace the delineator from its required position on a roadway. Other types of conventional delineators, adapted for semi-permanent attachment to a roadway or the like, tend to be relatively expensive to manufacture and difficult to install and replace, when necessary. For example, such delineators include those which require heavy and costly threaded elements adapted to secure an extruded plastic tube in place. Furthermore, special tooling is required to gain access to the threaded elements, through an open upper end of the marker or tube.

SUMMARY OF THE INVENTION

This invention overcomes the above briefly-described problems by providing a surface mount delineator comprising an elongated marker having a bottom wall formed on a lower end thereof, first access means formed through the bottom wall for receiving at least one fastener therethrough to secured the marker to a surface, and second access means formed through a side wall of the tube, adjacent to the first access means, for receiving a tool therethrough, such as a wrench, to selectively tighten or release the fastener.

A described first mounting arrangement for the marker comprises a mounting plate, having a bolt secured thereon, positioned beneath the marker and adapted to be suitably secured to a relatively flat and hard surface of a roadway or the like. The bolt extends upwardly through the first access means or opening formed through the bottom wall of the marker, and is adapted to have a nut secured thereon by a wrench accommodated by the second access means or opening formed through the side wall of the marker.

In a second described mounting arrangement for the marker, a mounting post is first driven into the ground with the mounting post having screw threads therein. A bolt extends downwardly from within the delineator in threaded engagement with a post to secure the marker in place. The latter mounting arrangement is particularly adapted for use on unpaved surfaces, such as on soil or gravel beds or shoulders.

BRIEF SUMMARY OF THE DESCRIPTION OF THE DRAWINGS

Other objects and advantages of this invention will become apparent from the following description and accompanying drawings wherein:

FIG. 4 is a front elevational view of the delineator, but showing a second mounting arrangement for attaching the marker thereof on an unpaved surface;

FIG. 5 illustrates the driving-in of a mounting post for the purpose of mounting the tube thereon;

FIG. 6 illustrates an upper end of the mounting post in phantom lines with an adapter tool mounted thereon for preventing damage to the post when it is driven into the ground;

FIG. 7 is a sectional view, similar to FIG. 3, but showing attachment of the tube to the mounting post by the second mounting arrangement;

BEST MODE OF CARRYING OUT THE INVENTION

Figure 1:
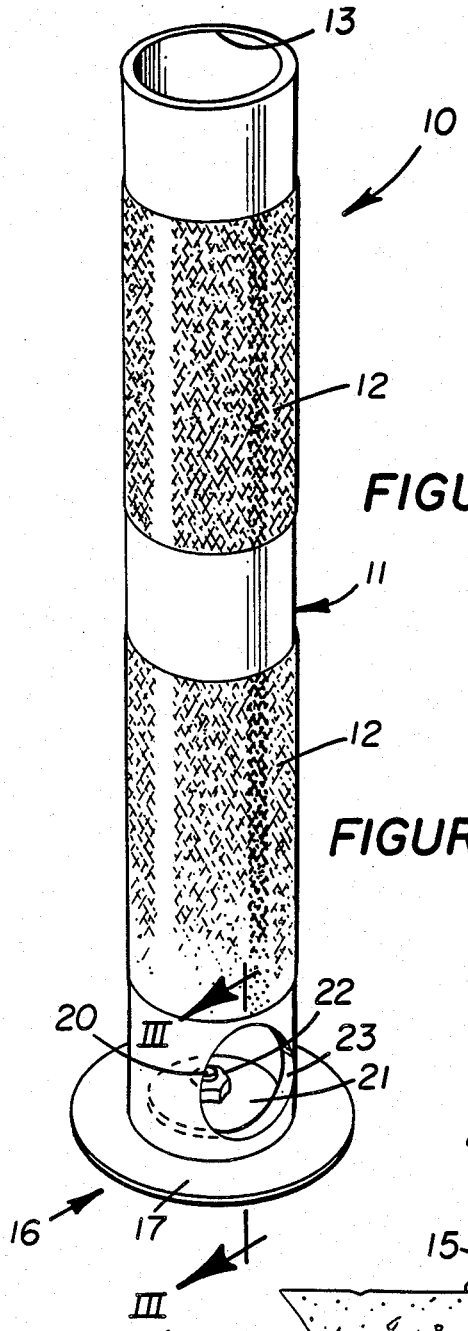
FIG. 1 is an isometric view of a flexible surface mount delineator embodying this invention.
Figure 2:
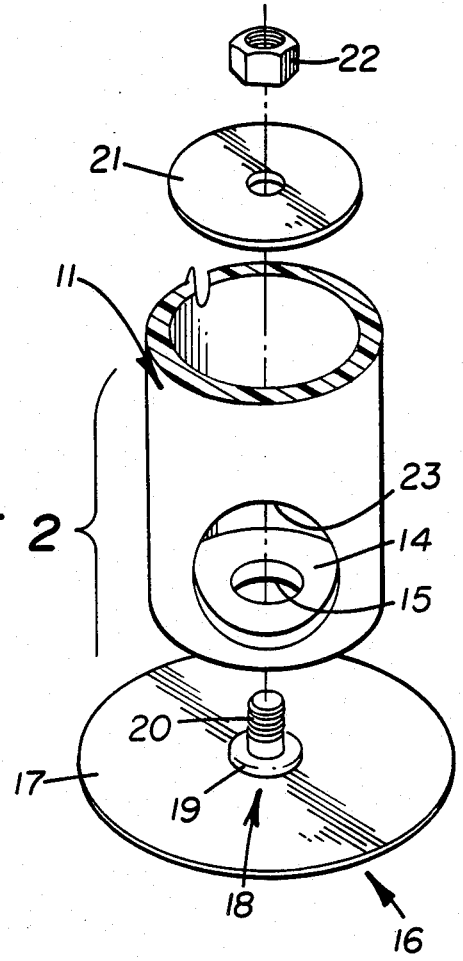
FIG. 2 is a partial exploded view of the delineator, showing a first mounting arrangement for attaching a marker, shown in the form of a flexible tube, of the delineator to a roadway or the like having a relatively flat and hard surface.
Figure 3:
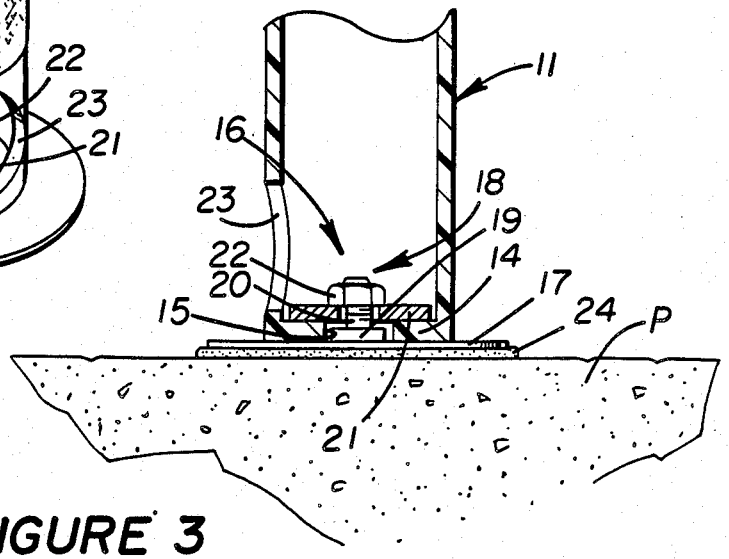
FIG. 3 is a cross-sectional view through the delineator, generally taken in the direction of arrows III—III in FIG. 1, showing the first mounting arrangement in its assembled form.

FIGS. 1–3 illustrate a delineator 10 adapted for securance in an upstanding position on pavement P, such as a cement or asphalt roadway having a relatively flat and hard mounting surface defined thereon. The delineator may comprise an elongated marker 11, shown in the form of a cylindrical flexible tube forming a hollow post. The tube is preferably composed of a lightweight and semi-rigid, but flexible plastic material, such as ethylene vinyl acetate. One or more reflective bands 12 may be adhesively or otherwise suitably secured on the tube for visual detection of the delineator when subject to light from automobile headlights or the like.

Figure 9:
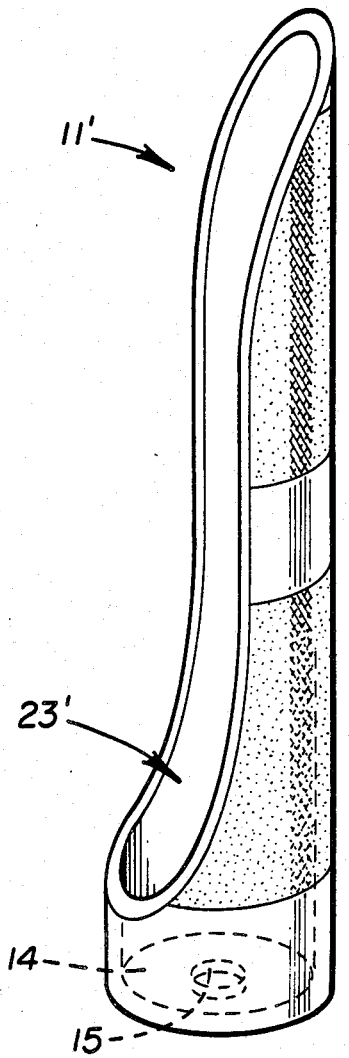
FIG. 9 illustrates one of the latter markers.

Marker or tube 11 may assume other shapes, such as one having a rectangular, oval, triangular or other desired cross-section or other desired shape. For example, FIG. 9 illustrates an alternate marker 11, hereinafter more fully described. In the illustrated embodiment, the marker has an open top 13 and a bottom wall 14 defined thereon.

A first access means 15, shown in the form of a circular opening formed centrally through bottom wall 14 of the tube, is adapted to receive a fastener of a first mounting arrangement 16 therethrough to secure the tube to pavement P. The first mounting arrangement comprises a circular mounting plate 17, preferably having a diameter at least as large as the diameter of the tube, and a bolt 18 secured centrally of the mounting plate.

As shown in FIG. 3, a head 19 of the bolt may be welded or otherwise suitably secured on the mounting plate and a threaded shank 20 of the bolt extends upwardly through access opening 15. Bolt head 19 is preferably in the form of an annular boss disposed in opening 15 and has a diameter slightly less than the inside diameter of the opening to provide means in the form of a boss for precisely centering tube 11 on mounting plate 17. A flat washer 21 is mounted on the bolt shank and on bottom wall 14 of the tube and has an inside diameter slightly less than the inside diameter of the tube, but a diameter substantially larger than the diameter of opening 15. The washer functions to clamp the bottom wall of the tube to the clamping plate when a nut 22, positioned on an inner surface of the washer and interiorly of the tube, is threadably secured on shank 20 of the bolt.

As further shown in FIG. 3, a second access means 23, shown in the form of a second circular opening formed through a side wall of tube 11, is adapted to receive a suitable wrench therethrough to selectively tighten or release nut 22. Mounting plate 17 may be directly mounted and secured on the surface of pavement P with a standard adhesive 24, such as an epoxy "button" adhesive. Alternatively, mounting plate 17 could be mechanically secured in place by studs driven therethrough or the plate could be eliminated and bolt 18 driven and anchored directly into the pavement for mounting purposes. It can be seen that mounting arrangement 16 facilitates expeditious installation and replacement of tube 11, if needed, with only the use of a standard wrench.

The delineator may be installed on pavement P by assembling the delineator in its FIG. 3 erected condition and then securing mounting plate 17 to the pavement, such as by epoxy adhesive 24 or other suitable types of mechanical fasteners. Alternatively, the delineator can be installed by first securing only the mounting plate to the pavement and then assembling the delineator on the mounting plate. In the latter method of assembly, the workman would simply drop washer 21 through open end 13 of tube 11, position opening 15 on centering boss or bolthead 19 and then position shank 20 of the bolt to project upwardly through the washer. The workman would then tighten nut 22 on the bolt with a standard ratchet, open-end or box wrench whereby washer 21 will function to clamp bottom wall 14 of tube 11 between mounting plate 17 and washer 21. As suggested above, a third method of assembly contemplates elimination of mounting plate 17 and the direct securance of bolt 18 in pavement P.

FIGS. 4–7 illustrate a second mounting arrangement 16′ for delineator 10, adapted to mount marker or tube 11 on an unpaved ground surface G. As shown in FIGS. 5 and 6, a workman initially drives a mounting post 25 of the mounting arrangement into the ground so that the top of the post is substantially at ground level (FIG. 7). The post may comprise any suitable rigid member for this purpose, such as a steel pipe, a U-shaped channel bar, a Fiberglas rod, etc. An adapter tool 26 is adapted to be positioned on the post when the post is driven into the ground with a sledgehammer 27.

As shown in FIG. 6, the adapter tool has a centrally-disposed and tapered boss 28 formed thereon to define an annular cavity 29 adapted to receive an upper end of the tubular mounting post therein. A plastic liner 30 is preferably secured in the adapter to aid in retaining the adapter on the end of the mounting post and to also prevent metal-to-metal contact therebetween to prevent swaging or other damage to the upper end of the post.

Referring now to FIGS. 4 and 7, mounting arrangement 16′ further comprises screw threads defined within the upper end of post 25 and a bolt 32 threaded to the nut and extending downwardly through washer 21, opening 15 and a central opening 33 formed through a mounting plate 34. Although screw threads 31 are shown formed internally on a nut welded within the post, the threads could be formed directly and internally on post 25, for example. Mounting plate 34 functions in a manner similar to mounting plate 17 of the first-described mounting arrangement, and is shown in the form of a large washer preferably having an outside diameter at least as large as that of tube 11. A head 35 of bolt 32 is larger than the central opening formed through washer 21 to clamp bottom wall of the tube between the washer and mounting plate 34.

As briefly described above, installation of the delineator by use of second mounting arrangement 16′ is commenced by driving mounting post 25 into the ground. Mounting plate 34 is then suitably positioned on the top of the post, and washer 21 and bolt 32 are dropped downwardly into tube 11 so that a threaded shank 36 of the bolt projects downwardly through openings 15 and 33. The bolt is then tightened into nut 32 by a workman, by use of a standard wrench positioned through access opening 23.

Figure 8:
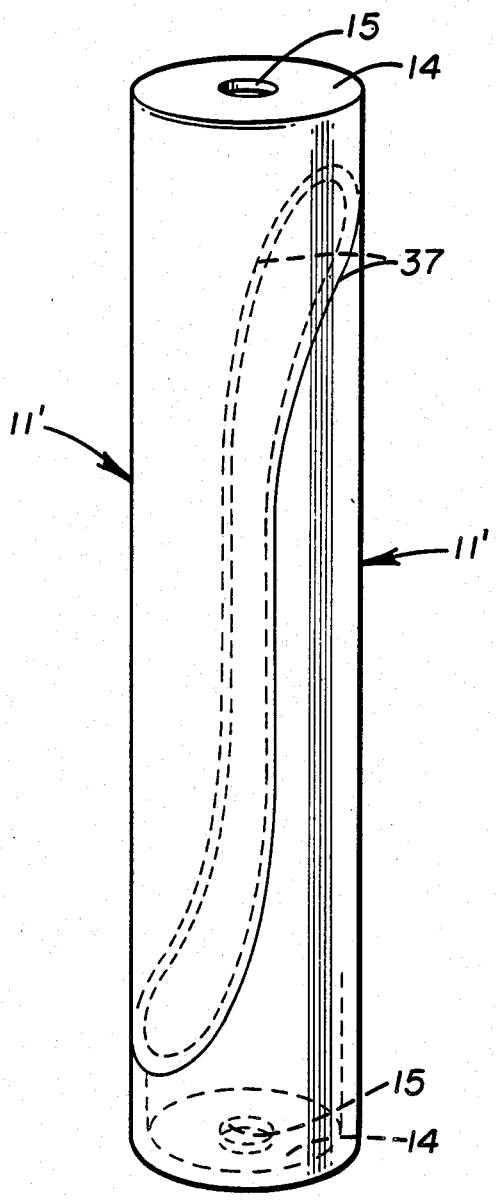
FIG. 8 illustrates a molded plastic tube adapted to form a pair of identical and alternate markers.

FIG. 8 illustrates a molded plastic cylinder adapted to be severed along a cut line 37 to define two identical and alternate markers 11′ (FIG. 9), i.e., each marker is a section of a right cylinder. Each marker 11′ includes a bottom wall 14, a first access opening 15 and a second access opening 23′, adjacent to access opening 15, all for purposes described above. It should be noted that the forming of marker 11′ includes the steps of forming the FIG. 8 right cylinder and then severing the cylinder entirely about the periphery thereof along continuous cut line 37 that extends from a first end to a second end of the cylinder and along opposite sides thereof to define a pair of markers 11′. Access openings 15 can be formed during the molding process or can be formed thereafter, either in the cylinder proper or in each respective bottom wall 14 of each marker 11′.

From the above description, it can be seen that this invention provides a relatively inexpensive and versatile surface mount delineator that can be installed and replaced expeditiously. The delineator can be suitably mounted on hard flat surfaces, such as concrete or asphalt pavement P (FIG. 3), or on unpaved ground G (FIG. 7), such as an earthen or gravel surface. The provision of second access openings 23 (FIGS. 1 and 4) and 23′ (FIG. 9) allows the workman easy access to the nut or bolt utilized to secure marker 11 or 11′ in place.

I claim:

1. A surface delineator kit comprising an elongated and unitary marker entirely composed of a flexible semi-rigid plastic material defining a cylindrical post of uniform circular cross-section and having a circular bottom wall formed on a lower end thereof and an open top defined at an upper end thereof having a diameter corresponding to the diameter of an inner circular surface of said bottom wall, a first access opening formed centrally through said bottom wall and adapted to receive a fastener therethrough to secure said marker to a surface, a circular second access opening formed through a side wall of said marker, closely adjacent to said bottom wall and adjacent to said first access opening, adapted to receive a tool therethrough to selectively tighten or release said fastener, fastening means, including a fastener having a head and an annular washer mounted between said head and the inner circular surface of said bottom wall, for releasably attaching said marker to a stationary mounting surface, said washer substantially conforming to the inner circular surface of said bottom wall and having an outer diameter slightly less than said open top, the inner circular surface of said bottom wall and an inner circular cross-section of said post, but greater than said circular second access opening whereby said washer can only be positioned in said post through the open top thereof and not through said second access opening, and a mounting plate mounted beneath the bottom wall of said marker and having an outer dimension at least as large as the outer dimension of said bottom wall whereby tightening of said fastener through said circular second access opening will clamp the substantial entirety of said bottom wall between said washer and said mounting plate.

2. The surface mount delineator kit of claim 1 wherein said fastener comprises a bolt secured centrally on said mounting plate and a nut adapted to be threadably mounted on a threaded shank of said bolt.

3. The surface mount delineator kit of claim 1 further comprising an elongated mounting post having screw threads therein and said fastener comprises an elongated bolt adapted to be inserted downwardly and sequentially through said washer, said first access opening, and said mounting plate, and into threaded engagement with said screw threads.

4. A surface mount delineator for mounting on a roadway comprising an elongated traffic marker, said traffic marker being made by the following method steps forming a cylinder having flat first and second bottom walls formed on opposite ends thereof, and severing said cylinder entirely about the periphery thereof and along a continuous cut line extending generally longitudinally from a frist end adjacent to said first bottom wall to a second end adjacent to said second bottom wall of said cylinder and along opposite sides thereof to define a substantially identical pair of said traffic markers adapted for mounting on said roadway.

* * * * *